US011299861B2

(12) United States Patent
Koseki et al.

(10) Patent No.: US 11,299,861 B2
(45) Date of Patent: Apr. 12, 2022

(54) RAMMER

(71) Applicant: SAKAI HEAVY INDUSTRIES, LTD., Tokyo (JP)

(72) Inventors: Tetsuya Koseki, Saitama (JP); Hikaru Hosaka, Saitama (JP)

(73) Assignee: SAKAI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 16/981,276

(22) PCT Filed: Feb. 21, 2019

(86) PCT No.: PCT/JP2019/006609

§ 371 (c)(1),
(2) Date: Sep. 15, 2020

(87) PCT Pub. No.: WO2019/176497

PCT Pub. Date: Sep. 19, 2019

(65) Prior Publication Data

US 2021/0040700 A1 Feb. 11, 2021

(30) Foreign Application Priority Data

Mar. 15, 2018 (JP) ..... 2018-047739

(51) Int. Cl.
*E01C 19/38* (2006.01)
*E01C 19/35* (2006.01)
*E01C 19/40* (2006.01)

(52) U.S. Cl.
CPC ..... *E01C 19/35* (2013.01); *E01C 19/38* (2013.01); *E01C 19/402* (2013.01)

(58) Field of Classification Search
CPC ..... E01C 19/35; E01C 19/38; E01C 19/402
(Continued)

(56) References Cited

U.S. PATENT DOCUMENTS 3,972,637 A * 8/1976 Sutherland ..... E02D 3/074 404/133.1
4,015,909 A * 4/1977 Yamamoto ..... E02D 3/068 404/133.1

(Continued)

FOREIGN PATENT DOCUMENTS

JP S4995403 8/1974
JP H067876 2/1994

(Continued)

OTHER PUBLICATIONS

International Search Report, PCT/JP2019/006609, dated Apr. 23, 2019.
Office Action, Chinese Patent Office; dated Sep. 15, 2021.

*Primary Examiner* — Raymond W Addie
(74) *Attorney, Agent, or Firm* — CRGO Global; Steven M. Greenberg

(57) ABSTRACT

A rammer includes: an outer cylinder (31); an inner cylinder (32) slidably contacted with an inside of the outer cylinder (31); a slider (33) connected to a connecting rod (14) and slidably provided in the inner cylinder (32); a first coil spring (34) housed in the upper part of the inner cylinder (32); and a second coil spring (35) housed in the lower part of the inner cylinder (32), wherein the slider (33) is disposed between the first coil spring (34) and the second coil spring (35), wherein a crank shaft has a rotational axis disposed orthogonally to the moving direction, and the first coil spring (34) and the second coil spring (35) have respectively different winding directions to each other.

4 Claims, 8 Drawing Sheets

(58) Field of Classification Search
USPC ..... 404/133.05, 133.1
See application file for complete search history.

(56) References Cited

U.S. PATENT DOCUMENTS

| | | | | |
|---|---|---|---|---|
| 4,104,001 | A * | 8/1978 | Uebel | E02D 3/068 404/133.1 |
| 4,113,403 | A * | 9/1978 | Tertinek | E02D 3/074 404/113 |
| 6,302,622 | B1 * | 10/2001 | Nagasawa | E01C 19/35 404/133.05 |
| 6,848,858 | B1 | 2/2005 | Greppmair | |
| 2004/0165953 | A1 | 8/2004 | Greppmair | |

FOREIGN PATENT DOCUMENTS

| | | | |
|---|---|---|---|
| JP | H11140815 | A | 5/1999 |
| JP | 2001515976 | A | 9/2001 |

* cited by examiner

Acceleration distribution on top surface of rammer body with Reverse Wound Spring, i.e., First outer coil spring: right-handed, Second outer coil spring: left-handed Acceleration distribution on left lateral surface of rammer body with Reverse Wound Spring, i.e., First outer coil spring: right-handed, Second outer coil spring: left-handed Acceleration distribution on top surface of rammer body with Forward Wound Spring, i.e., First outer coil spring: right-handed, Second outer coil spring: right-handed Acceleration distribution on left lateral surface of rammer body with Forward wound spring, i.e., First outer coil spring: right-handed, Second outer coil spring: right-handed

RAMMER

CROSS-REFERENCE TO RELATED APPLICATIONS

This application is a § 371 national phase entry of International Application No. PCT/JP2019/006609, filed Feb. 21, 2019, which claims priority to Japanese Patent Application No. 2018-047739, filed Mar. 15, 2018.

TECHNICAL FIELD

The present invention relates to a rammer.

BACKGROUND ART

Patent Document discloses a conventional rammer which includes an engine, a reciprocating mechanism to convert a rotational force of the engine into a reciprocal force, a leg part disposed to lean forward in a moving direction and being moved up and down by the reciprocating mechanism, and a compacting plate disposed at an bottom of the leg part.

The reciprocating mechanism includes a crank mechanism where a pinion gear of an output shaft of the engine is engaged with a crank gear of a crank shaft. The crank gear is provided with a crank pin at a position offset from the rotational axis of the crank shaft, and a connecting rod is connected to the crank pin. The crank shaft is disposed in a front-rear direction (strictly speaking, inclined forward and downward in the front-rear direction of a rammer body), and a connecting rod rotates while being repeatedly displaced in a right-left direction of the rammer body.

PRIOR ART REFERENCE

Patent Document

Patent Document 1: Japanese Patent Application Publication No. JPH11-140815

SUMMARY OF THE INVENTION

Problem to be Solved

According to the technique of the Patent Document 1, the connecting rod is displaced in a right-left direction of the rammer body, and the rammer body also sways in the right-left direction, to have a risk of being unstable.

The present invention is intended to provide a rammer having excellent stability in the position of the rammer body to address such a problem.

Means to Solve Problem

To solve the problem, the present invention provides a rammer including: an engine; a reciprocating mechanism including a crank shaft and a connecting rod and configured to convert a rotational force of the engine into a reciprocal force; a leg part disposed to lean forward in a moving direction and configured to be moved up and down by the connecting rod; and a compacting plate disposed at a bottom of the leg part. The leg part includes: an outer cylinder; an inner cylinder slidably contacted with an inside of the outer cylinder; a slider connected to the connecting rod and slidably provided in the inner cylinder; a first coil spring housed in an upper part of the inner cylinder; and a second coil spring housed in a lower part of the inner cylinder. The slider is disposed between the first coil spring and the second coil spring. The crank shaft has a rotational axis disposed orthogonally to the moving direction. The first coil spring and the second coil spring have respectively different winding directions to each other.

According to the present invention, the connecting rod is displaced in a front-rear direction of the rammer, and swaying of the rammer in a right-left direction is reduced when the rammer moves forward, and a gyro effect allows the rammer to stably jump forward. The first coil spring and the second coil spring have respectively different winding directions to each other, and thus twisted forces from the springs cancel each other out to further improve stability of the rammer.

The present invention also has a feature that a thrust bearing is provided on at least one of an end of the first coil spring and an end of the second coil spring.

In the present invention, the thrust bearing absorbs the twisted force generated by expanding and contracting of the springs and thus further reduces the twisted force impacting on the rammer body.

Advantageous Effects of the Invention

In the present invention, the connecting rod is displaced in a front-rear direction of the rammer, to have swaying of the rammer in a right-left direction reduced while the rammer moves forward, and the gyro effect improves stability of forward movement of the rammer. The first coil spring and the second coil spring have respectively different winding directions to each other, and thus the twisted forces from the springs cancel each other out to further improve stability of the rammer.

EMBODIMENTS OF THE INVENTION

Figure 1:
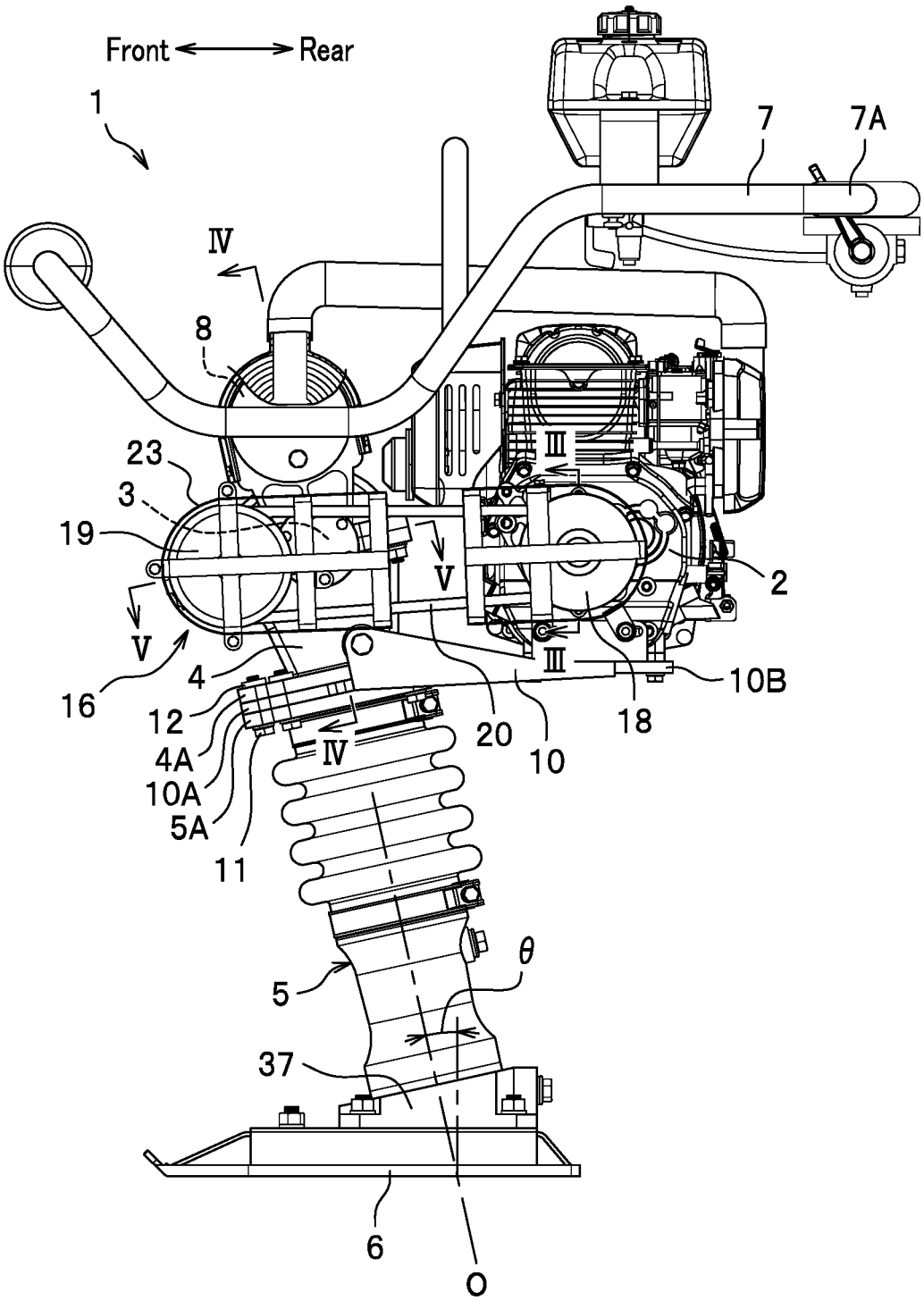
FIG. 1 is a side view of a rammer according to the present invention.
Figure 2:
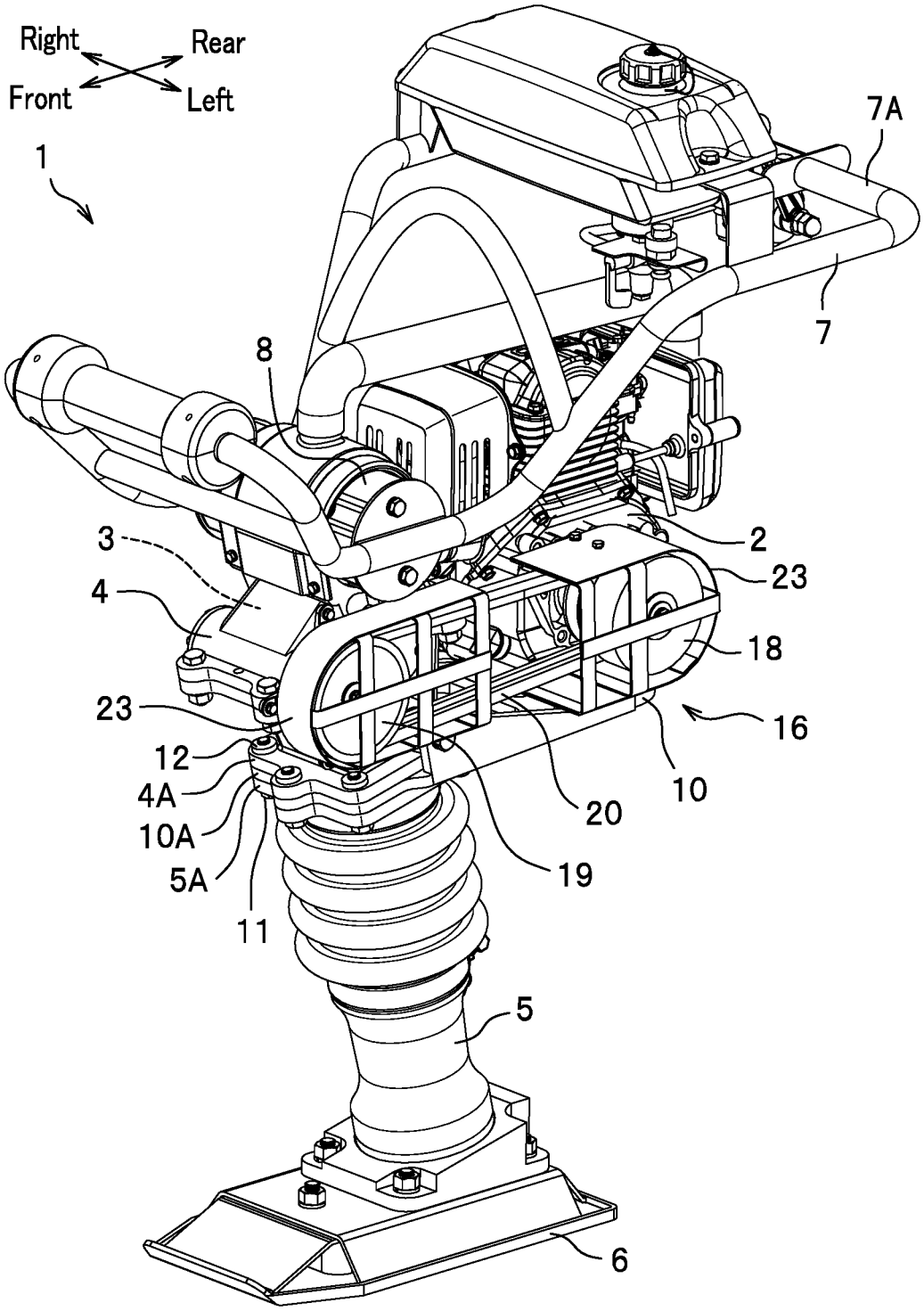
FIG. 2 is a perspective view of an appearance of the rammer according to the present invention.

A rammer 1, as shown in FIGS. 1 and 2, includes: an engine 2; a reciprocating mechanism 3 to convert a rotational force of the engine 2 into a reciprocal force; a case 4 to house the reciprocating mechanism 3; a leg part 5 disposed to lean forward in a moving direction and moved up and down; a compacting plate 6 disposed at the bottom of the leg part 5, and a handle 7 for steering. The leg part 5 is disposed to lean forward at an angle of θ to a vertical direction.

The handle 7, as shown in FIGS. 1 and 2, is attached to both sides of the upper part of the case 4 via an antivibration rubber 8. The handle 7 is made of a material such as a steel pipe. The handle 7 in a quadrangular frame shape surrounds the case 4 and the engine 2 in a planar view. The handle 7 includes a gripping part 7A at the rear end which an operator grips.

Figure 3:
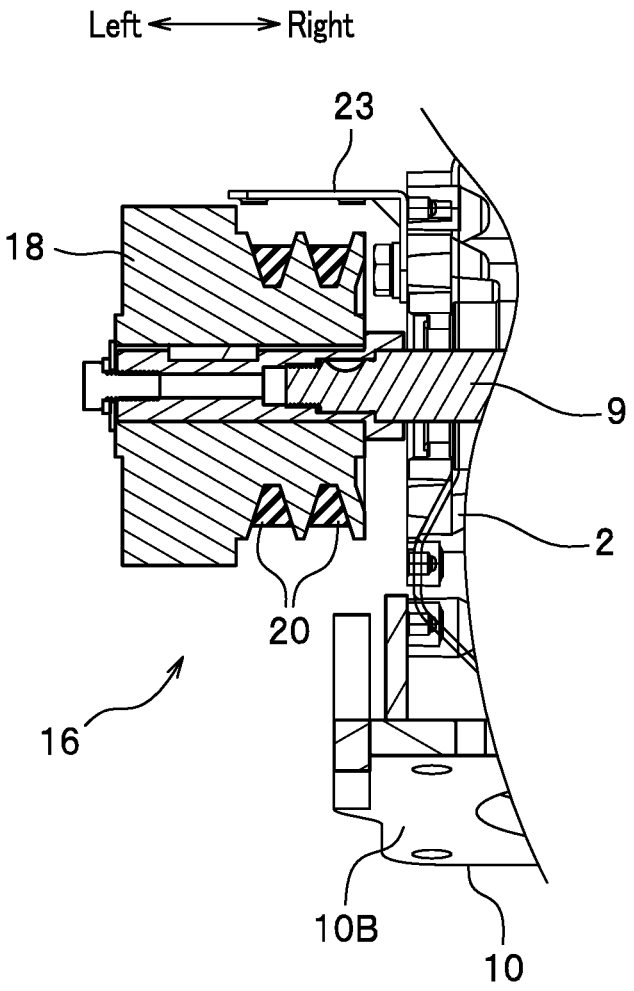
FIG. 3 is a cross-sectional view taken along a line in FIG. 1.
Figure 6:
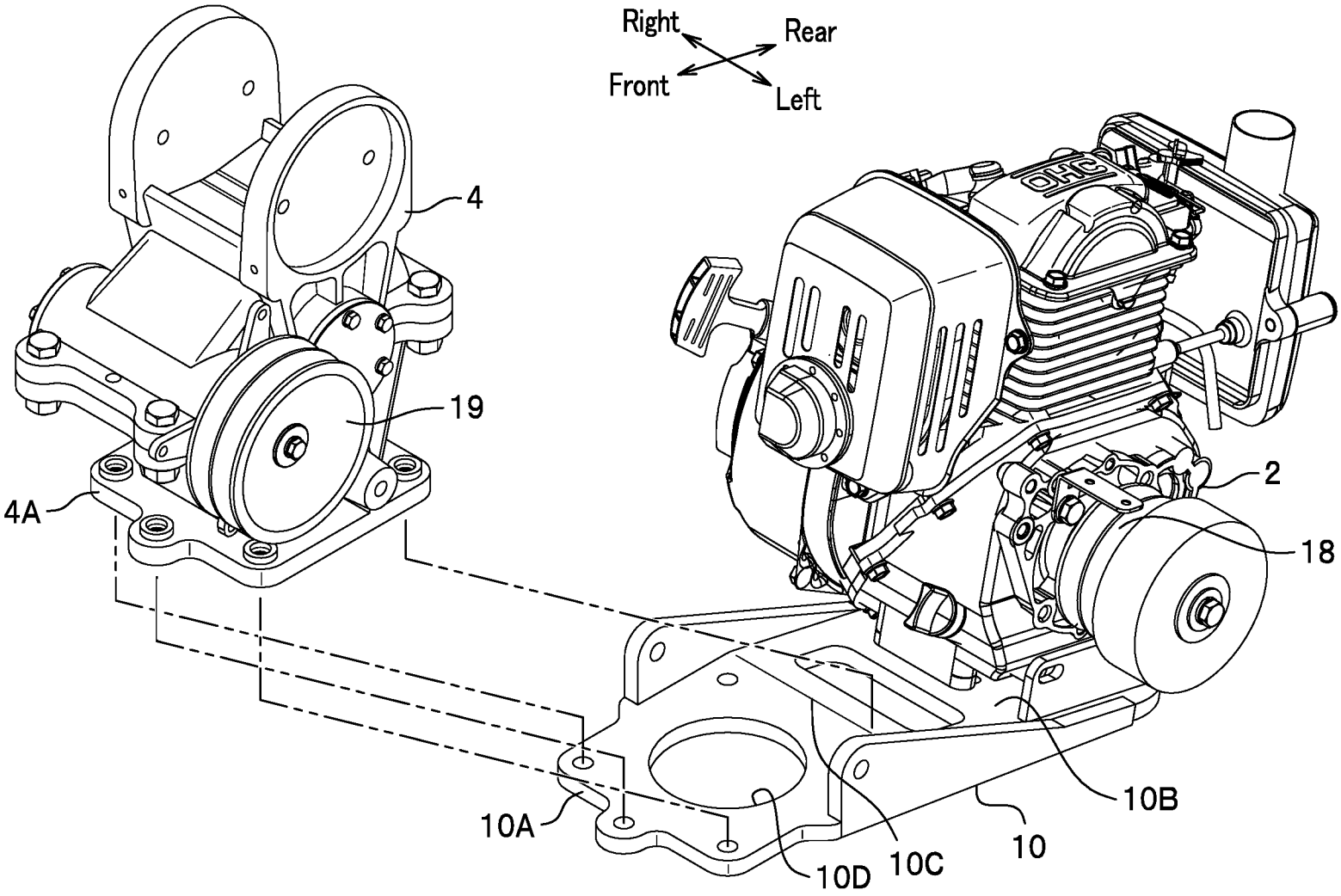
FIG. 6 is a partially exploded perspective view of the rammer according to the present invention.

The engine 2 is a gasoline engine for example. The engine 2 includes an output shaft 9 (see FIG. 3) extending in a lateral direction from the lower part of the engine and disposed to extend leftward. That is, the engine 2 is disposed such that the output shaft 9 extends in a right-left direction. The engine 2 is arranged apart backward from the case 4 and disposed on a plate member 10 extending backward from the lower part of the case 4. The plate member 10, with reference to FIG. 6 as well, includes: a fixing part 10A, leaning forward, to be held between a lower flange 4A of the case 4 and an upper flange 5A of the leg part 5 and fastened and fixed with bolts 11 and nuts 12. The plate member 10 includes an engine mounted part 10B on which the engine 2 is mounted, to extend horizontally from the rear part of the fixing part 10A via a bent part 10C which is bent such that the ridge line is formed to extend in a right-left direction. The fixing part 10A is formed with a through hole 10D through which the connecting rod 14 is inserted.

Reciprocating Mechanism 3

Figure 4:
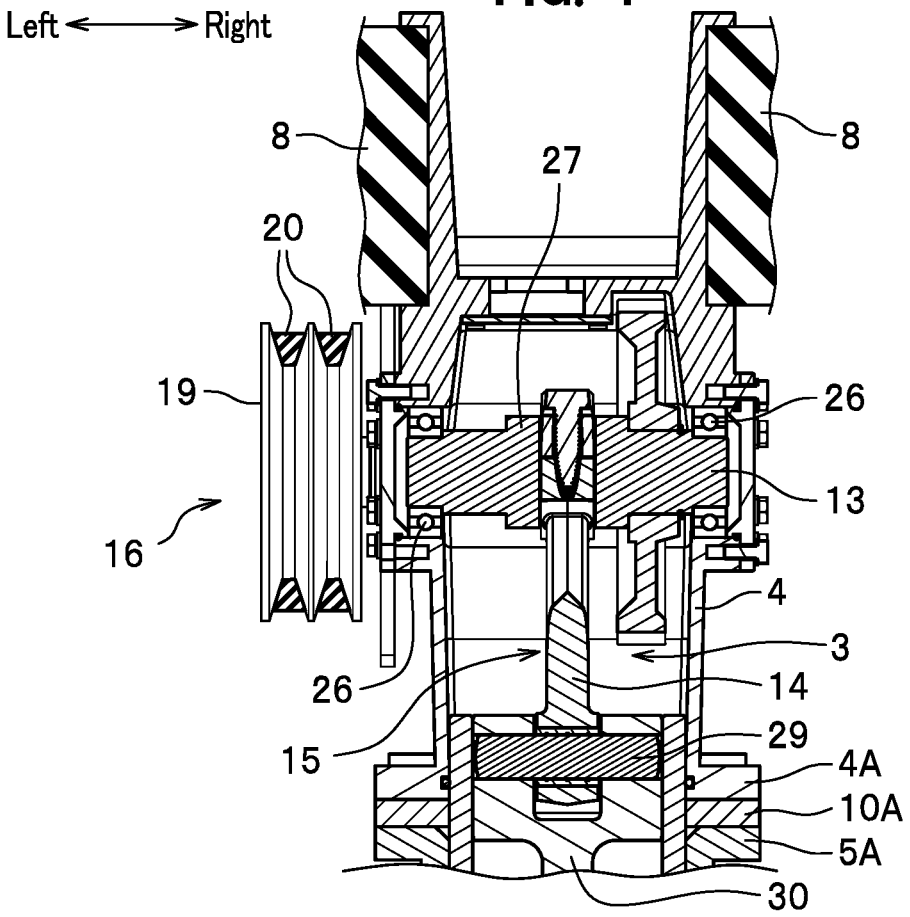
FIG. 4 is a cross-sectional view taken along a line IV-IV in FIG. 1.
Figure 5:
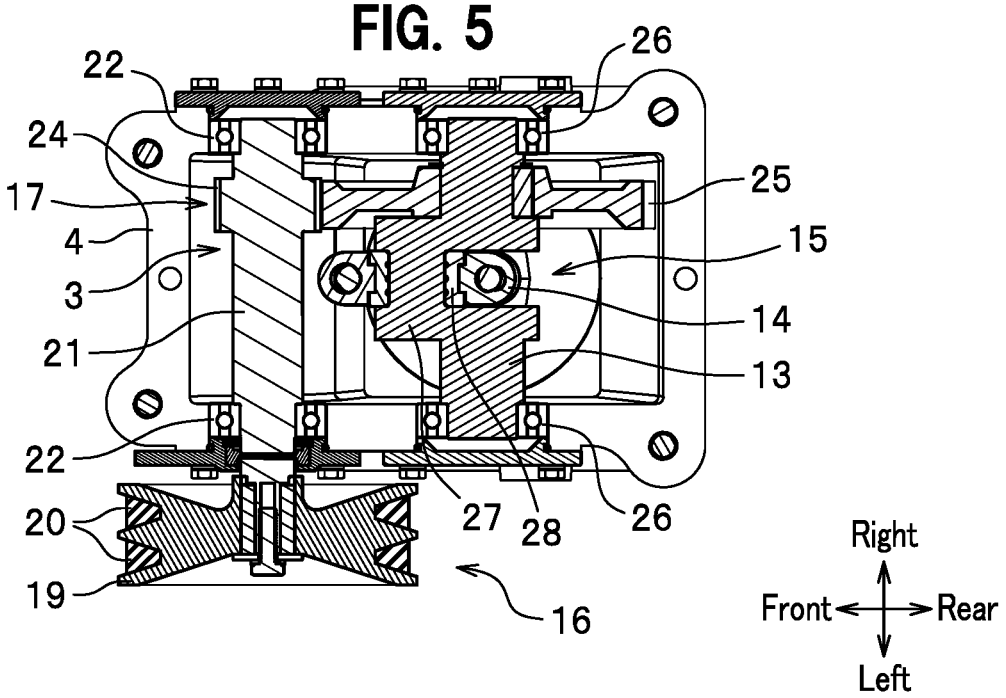
FIG. 5 is a cross-sectional view taken along a line V-V in FIG. 1.

The reciprocating mechanism 3, as shown in FIGS. 4 and 5, includes a crank mechanism 15 having a crank shaft 13 and the connecting rod 14. The reciprocating mechanism 3 of the present embodiment includes a belt deceleration mechanism 16 and a gear deceleration mechanism 17.

The belt deceleration mechanism 16 includes: a driving pulley 18 axially attached on the output shaft 9 of the engine 2 (see FIG. 3); a driven pulley 19 having a diameter larger than the driving pulley 18; and a belt 20 wound between the driving pulley 18 and the driven pulley 19. As shown in FIG. 5, a gear shaft 21, whose rotational axis is set in a right-left direction, is disposed inside the case 4. Both ends of the gear shaft 21 are axially supported by the case 4 via a bearing 22. The left end of the gear shaft 21 protrudes outward from the case 4. The driven pulley 19 is axially attached on the protrusion of the gear shaft 21. That is, the belt 20 is wound between the driving pulley 18 and the driven pulley 19, each having a rotational axis set in a right-left direction, and is disposed at the left of the engine 2 and case 4 so as to be arranged in a front-rear direction. A cover 23, which protects the belt deceleration mechanism 16, is attached to the engine 2 and case 4 via a bracket or the like, as shown in FIGS. 1 and 2.

In FIG. 5, the gear deceleration mechanism 17 includes a pinion gear 24 to be rotated integrally with the driven pulley 19 and a large diameter gear 25 attached on the crank shaft 13 and engaged with the pinion gear 24. The pinion gear 24 is formed coaxially and integrally on the gear shaft 21 at a portion closer to the right end of the gear shaft 21.

The crank shaft 13 is disposed behind the gear shaft 21 with the rotational axis of the crank shaft 13 set in the right-left direction orthogonal to the moving direction of the rammer 1. Both ends of the crank shaft 13 are axially supported by the case 4 via a bearing 26. The large diameter gear 25 is axially attached to the crank shaft 13 at a portion close to the right end of the crank shaft 13. The crank shaft 13 is formed with a crank pin 27, which is being offset from the rotational axis of the crank shaft 13, at the center in the axial direction. The crank pin 27 is connected to the upper part of the connecting rod 14 via a bush 28. The lower part of the connecting rod 14, as shown in FIG. 4, is connected to the piston 36 of the cylinder mechanism 30 via a pin 29.

Cylinder Mechanism 30

Figure 7:
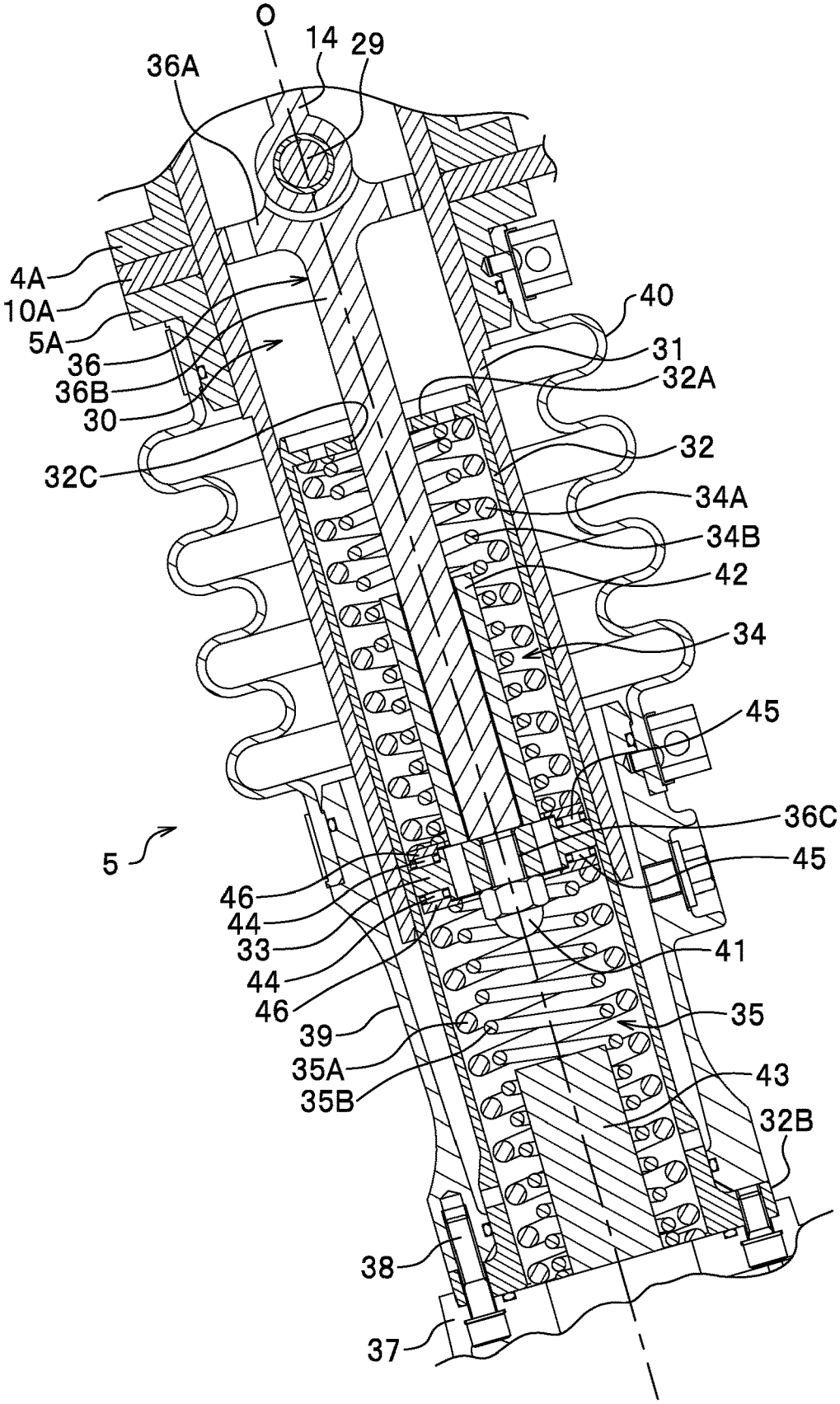
FIG. 7 is a lateral cross-sectional view of a leg part of the rammer according to the present invention.

The leg part 5, as shown in FIG. 7, includes the cylinder mechanism 30. The cylinder mechanism 30 includes: an outer cylinder 31, an inner cylinder 32 slidably contacted with an inside of the outer cylinder 31; a slider 33 connected to the connecting rod 14 and slidably provided in the inner cylinder 32; a first coil spring 34 housed in the upper part of the inner cylinder 32; and a second coil spring 35 received in the lower part of the inner cylinder 32. The slider 33 is disposed between the first coil spring 34 and the second coil spring 35.

The outer cylinder 31 has a cylindrical shape having upper and lower ends thereof opened. The piston 36 is slidably housed inside the outer cylinder 31 and has a sliding part 36A connected to the connecting rod 14 and sliding in the upper part of the outer cylinder 31 and also has a coupling rod 36B extending downward from the sliding part 36A. The lower end of coupling rod 36B is provided with a male screw 36C threaded downward. An upper flange 5A is fixed on the outer circumference of the upper part of the outer cylinder 31 by welding or the like. The upper flange 5A, as mentioned above, is fastened with the bolts 11 and the nuts 12 to the lower flange 4A of the case 4. The plate member 10 is sandwiched between the upper flange 5A and the lower flange 4A. Accordingly, the outer cylinder 31 is fixed integrally to the case 4 with the bolts 11 and the nuts 12.

The inner cylinder 32 has the upper side inserted in the outer cylinder 31 from the opening part at the lower end of the outer cylinder 31 and contact with an inside of the outer cylinder 31. A spring-supporting plate 32A is formed at the upper end of the inner cylinder 32. A through hole 32C, which the coupling rod 36B of the piston 36 passes through, is formed at the center of the spring-supporting plate 32A. A flange 32B is formed on the outer circumference of the lower end of the inner cylinder 32. The upper end of the compacting plate 6 is provided integrally with a leg base 37. The flange 32B of the inner cylinder 32 is fastened to the leg base 37 with bolts 38.

A cylindrical leg cover 39 is arranged on the outer side of the inner cylinder 32 and fastened together with the inner cylinder 32 with the bolts 38. A waved bellows 40 is disposed between the leg cover 39 and the upper flange 5A. The bellows 40 is made of a rubber or the like and couples the outer cylinder 31 with the inner cylinder 32 to support a sliding movement between them.

The slider 33 is a circular plate member which has an outer surface sliding on the inner surface of the inner cylinder 32. The slider 33 is fastened and fixed to the lower end of the coupling rod 36B of the piston 36 with a nut 41 and a male screw 36C passing through a through hole of the slider 33. The upper part of the slider 33 and the upper part of the leg base 37 are provided with stoppers 42 and 43, respectively. The stoppers 42 and 43 contact the spring-supporting plate 32A and the nut 41 when excessive vibration occurs, to regulate stroke of the inner cylinder 32. The stopper 42 and 43 also serve to reduce a position deviation of a first inner coil spring 34B and a second inner coil spring 35B to be described below.

In the present embodiment, the first coil spring 34 includes a first outer coil spring 34A having a larger diameter and a first inner coil spring 34B having a smaller diameter arranged inside the first outer coiled spring 34A. The first outer coil spring 34A and the first inner coil spring 34B have respectively different winding directions to each other to prevent each spring from engaging with each other, such that, when the first outer coil spring 34A is right-handed, the first inner coil spring 34B is left-handed. The first outer coil spring 34A and the first inner coil spring 34B have upper ends thereof supported by the spring-supporting plate part 32A and have lower ends thereof supported by the slider 33 and housed in a compressed state in the inner cylinder 32.

A second coil spring 35 also includes a second outer coil spring 35A having a larger diameter and a second inner coil spring 35B having a smaller diameter and arranged inside the second outer coil spring 35A. The second outer coil spring 35A and the second inner coil spring 35B have respectively different winding directions to each other not to engage with each other. The second outer coil spring 35A and the second inner coil spring 35B have upper ends thereof supported by the slider 33 and have lower ends thereof supported by the leg base 37 and housed in a compressed state in the inner cylinder 32.

The first coil spring 34 and the second coil spring 35 have respectively different winding directions to each other and are housed in the inner cylinder 32. When a rammer has an outer coil spring and an inner coil spring as in the present embodiment, in regard to a relationship between the outer coil springs, that is, in regard to a relationship between the first outer coil spring 34A and the second outer coil spring 35A, they have respectively different winding directions to each other. Likewise, in regard to a relation between the inner coil springs, that is, in regard to a relationship between the first inner coil spring 34B and the second inner coil spring 35B, they also have respectively different winding directions to each other.

Thrust bearings 44 are provided between the lower end of the first coil spring 34 and the slider 33 and between the upper end of the second coil spring 35 and the slider 33, respectively. Respective thrust bearings 44 are housed in corresponding bearing housing parts 45 annularly recessed near outer circumferences of both the upper and lower surfaces of the slider 33. Each thrust bearing 44 includes needle bearing, roller bearing, or ball bearing. Washers 46 are in plane contact against the first coil spring 34 and the second coil spring 35 respectively and inserted between the first coil spring 34 and the thrust bearing 44 and between the second coil spring 35 and the thrust bearing 44 respectively. Each washer 46 is formed to have a lager thickness at a portion close to the outer edge than at the rest to prevent the washer 46 from inclining and loosely fitted in a bearing housing part 45.

Advantageous Effects

When the output shaft 9 of the engine 2 rotates, the gear shaft 21 rotates while being decelerated by the belt deceleration mechanism 16, and then the crank shaft 13 rotates while being decelerated by the gear deceleration mechanism 17. A crank movement of the connecting rod 14 results in an up-down movement of the slider 33, so that the first coil spring 34 and the second coil spring 35 expand and contract to move the inner cylinder 32 up and down relative to the outer cylinder 31. Thereby, the compacting plate 6 firmly compacts a ground.

The present invention has following advantageous effects. (1) The crank shaft 13 is disposed such that the rotational axis of the crank shaft 13 is set in a right-left direction, or an orthogonal direction to the moving direction of the rammer 1. This causes the connecting rod 14 to be displaced in the front-rear direction of the rammer 1 to reduce swaying of the rammer 1 in a right-left direction when moving forward, and to allow the rammer 1 to stably jump forward by the gyro effect.

(2) The first outer coil spring 34A and the second outer coil spring 35A have respectively different winding directions to each other. Thus, the resilient force of the first outer coil spring 34A generates a force moment on the spring-supporting plate 32A in one direction around a cylinder axis O of the cylinder mechanism 30, and the resilient force of the second outer coil spring 35A generates a force moment on the leg base 37 in the other direction around the cylinder axis O. Thus, the force moment generated on the spring-supporting plate 32A and the force moment generated on the leg base 37 cancel each other out, to reduce a twisting of the inner cylinder 32. Also on the slider 33, the resilient force of the first outer coil spring 34A generates a force moment in one direction around the cylinder axis O and the resilient force of the second outer coil spring 35A generates a force moment in the other direction around the cylinder axis O. Both force moments cancel each other out, to reduce the twisting of the slider 33. This reduces unstable portion of the rammer 1 due to the twisting. Advantageous effects between the first inner coil spring 34B and the second inner coil spring 35B are the same.

The thrust bearing 44 is provided at least one of the end part of the first coil spring 34 and the end part of the second coil spring 35, to have following advantageous effects. Twisted forces act on supporting parts for the four end parts which are both end parts of the first coil spring 34 and both end parts of the second coil spring 35. At least one of the end parts is provided with the thrust bearing 44 and this helps absorb the twisted force generated by expanding and contracting of the spring and thus further reduces the impact on a rammer body. The thrust bearing 44 may preferably be provided on both the upper and lower surfaces of the slider 33, as in the present embodiment, because the bearing housing parts 45 are formed in the slider 33 easily. Alternatively, the thrust bearing 44 may be provided in some cases between the upper end of the first coil spring 34 and the spring-supporting plate 32A or between the lower end of the second coil spring 35 and the leg base 37.

Test Cases

Figure 8A:
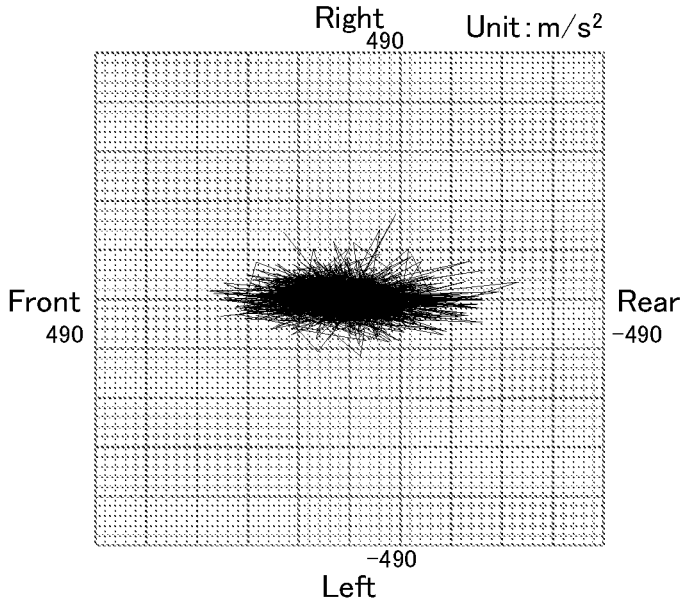
FIGS. 8A and 8B are graphs of an acceleration distribution of the rammer according to the present invention.
Figure 8B:
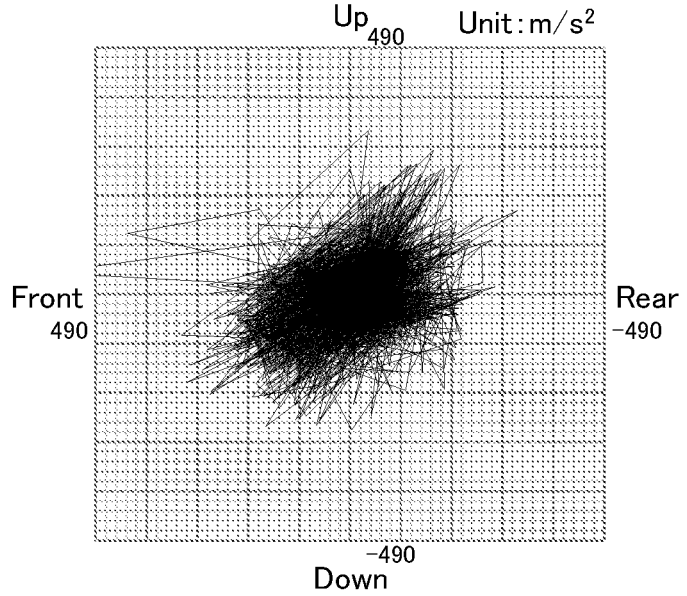
Figure 9A:
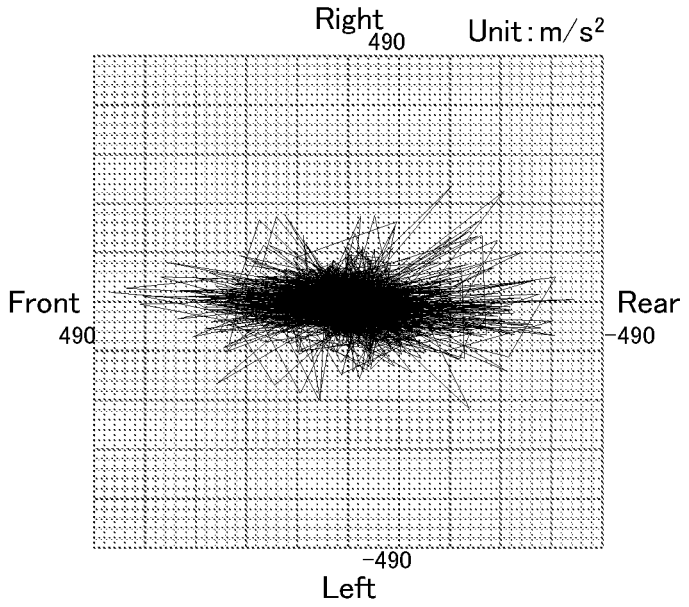
FIGS. 9A and 9B are graphs of an acceleration distribution of a conventional rammer.
Figure 9B:
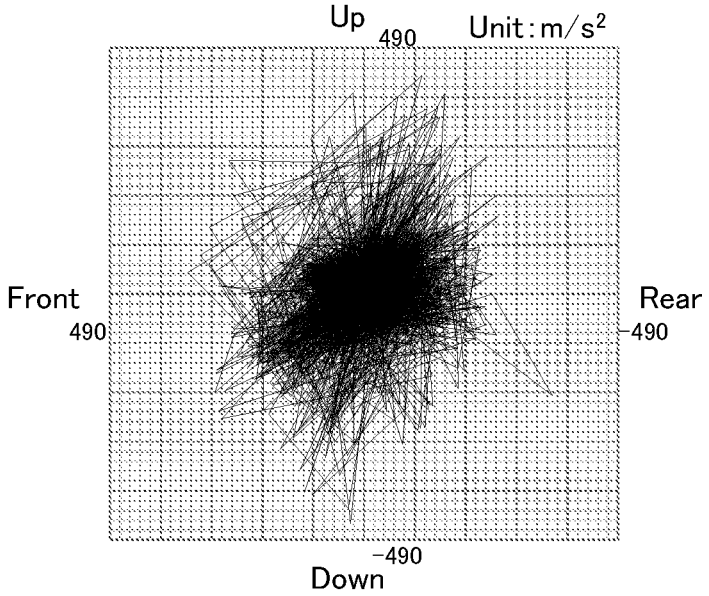

FIGS. 8A and 8B show graphs of an acceleration distribution of the rammer body measured when the rammer 1 of the present embodiment is made to vibrate at a specific point. FIG. 8A shows an acceleration distribution of the rammer body in front-rear and right-left directions in a planar view. FIG. 8B shows an acceleration distribution of the rammer body in front-rear and up-down directions in a lateral view. Note that the first outer coil spring 34A is right-handed and the second outer coil spring 35A is left-handed. FIGS. 9A and 9B show graphs of an acceleration distribution of the rammer body measured when a conventional rammer is made to vibrate at a specific point. FIG. 9A shows an acceleration distribution of the rammer body in front-rear and right-left directions in a planar view. FIG. 9B shows an acceleration distribution of the rammer body in front-rear and up-down directions in a lateral view. The first outer coil spring 34A and the second outer coil spring 35A are both right-handed.

As can be seen by a comparison of FIG. 8A and FIG. 9A or a comparison of FIG. 8B and FIG. 9B, the rammer 1 of the present embodiment has been confirmed to reduce the acceleration of the rammer body, that is, a variation in displacement of the rammer body in all the front-rear, right-left, and up-down directions to have a stable portion of the rammer body.

LIST OF REFERENCE SIGNS

1 Rammer
2 Engine
3 Reciprocating Mechanism
4 Case
5 Leg Part
6 Compacting Plate
13 Crank Shaft
14 Connecting Rod
15 Crank Mechanism
30 Cylinder Mechanism
31 Outer Cylinder
32 Inner Cylinder
33 Slider
34 First Coil Spring
34A First Outer Coil Spring
34B First Inner Coil Spring
35 Second Coil Spring
35A Second Outer Coil Spring
35B Second Inner Coil Spring
36 Piston
44 Thrust bearing
45 Bearing Housing Part

What is claimed is:

1. A rammer comprising:

an engine;

a reciprocating mechanism including a crank shaft and a connecting rod and configured to convert a rotational force of the engine into a reciprocal force;

a leg part disposed to lean forward in a moving direction and configured to be moved up and down by the connecting rod; and a compacting plate disposed at a bottom of the leg part, wherein the leg part includes:

an outer cylinder; an inner cylinder slidably contacted with an inside of the outer cylinder;

a slider connected to the connecting rod and slidably provided in the inner cylinder;

a first coil spring housed in the upper part of the inner cylinder; and a second coil spring housed in the lower part of the inner cylinder, a thrust bearing disposed on at least one of an end part of the first coil spring and an end part of the second coil, wherein the slider is disposed between the first coil spring and the second coil spring, wherein at least one of the first coil spring and the second coil is rotatable by the thrust bearing, wherein the crank shaft has a rotational axis disposed orthogonally to the moving direction, and wherein the first coil spring and the second coil spring have respectively different winding directions to each other.

2. The rammer according to claim 1, wherein the thrust bearing is provided between the slider and the at least one of the end part of the first coil spring and the end part of the second coil spring.

3. The rammer according to claim 1, wherein the thrust bearing is provided between the end part of the first coil spring and a spring supporting plate.

4. The rammer according to claim 1, wherein the thrust bearing is provided between the end part of the second coil spring and a leg base.

* * * * *